US005304974A

United States Patent [19]

Denton

[11] Patent Number: 5,304,974

[45] Date of Patent: Apr. 19, 1994

[54] LOW PROFILE THERMAL CUT-OFF RESISTOR

[75] Inventor: Monte Denton, Cedar Crest, N. Mex.

[73] Assignee: Siemens Stromberg-Carlson, Boca Raton, Fla.

[21] Appl. No.: 954,446

[22] Filed: Sep. 30, 1992

[51] Int. Cl.[5] ..... H01H 85/00

[52] U.S. Cl. ..... 337/4; 337/5; 361/104

[58] Field of Search ..... 337/4, 5, 1, 2, 407, 337/183; 219/511, 517, 535; 361/104

[56] References Cited

U.S. PATENT DOCUMENTS 4,328,387 5/1982 Kemble ..... 337/407
4,821,010 4/1989 Plasko ..... 337/4

OTHER PUBLICATIONS

Sales catalog entitled, "RCD Components Inc., Resistors, Coils, Delay Lines" by RCD Components Inc., Mar. 1987.

Sales catalog entitled, "Quality, Solutions, Service. The IRC Product Selection Guide. The complete line of resistive products" by International Resistive Company, Inc., Jan. 1992.

A component assembly drawing No. 2699E728, entitled "Envelope Drawing" dated Sep. 30, 1988 (last revision) by Elmwood Sensors, Inc., a subsidiary of Fasco Industries.

*Primary Examiner*—Harold Broome
*Attorney, Agent, or Firm*—Joseph S. Codispoti

[57] ABSTRACT

A thermal cut-off resistor that has an elongated thermal cut-off fuse; a wire-shaped resistor that is tightly coiled around the fuse, said resistor being physically connected to the fuse so that the fuse and the resistor are in an electrical series arrangement; and an electrically-insulated heat-resistant casing that contains the fuse and resistor therein and enables the fuse and the resistor to be secured and electrically connected to respective electrical contacts formed on a printed circuit board, the profile of the casing being approximately the width of the fuse.

22 Claims, 2 Drawing Sheets

LOW PROFILE THERMAL CUT-OFF RESISTOR

TECHNICAL FIELD

This invention relates to a thermal cut-off resistor. More particularly, this invention relates to a thermal cut-off resistor that has a low profile and an improved fault current interrupting capability.

BACKGROUND OF THE INVENTION

A telephone network consists of transmission systems that carry electrical information signals between two or more points; telephone sets that permit subscribers to transmit and receive the signals; and one or more switching systems that temporarily connect one transmission line to another line and, thus link two telephone sets. Since certain types of signals are better suited to certain types of transmission media because of bandwidth requirements, loss limits, etc., the characteristics of the type of signal traffic (e.g., voice, data, and video, in either analog, digital or hybrid form) dictate the physical configuration of the transmission systems used by the network. Consequently, a telephone network may be made up of a variety of transmission systems, each consisting of a transmission medium and its supporting structures, such as, telephone pole lines, underground conduit systems, buried systems, etc. Common transmission media include optical fibers and coaxial cable. The most prevalent type of transmission medium used in present telephone networks, however, is metallic paired cable. Metallic paired cable is composed of copper or aluminum conductors which are coated with an insulated material and which are twisted together into cables of various sizes, depending on the number of paired cables desired. The cables are further contained in a protective sheath that provides environmental protection.

The use of metallic paired cable for signal transmission is accompanied by high attenuation of the signals from one point to another. Attenuation is reduced in transmission systems using metallic paired cable to carry analog signals by the placement of lumped inductances, known as load coils, along the transmission lines. In transmission systems using metallic paired cable to carry digital signals, such as T1 carrier systems, attenuation is eliminated by the use of devices known as repeaters that receive digital signals, amplify or reshape the signals and then retransmit the modified signals. A repeater is commonly constructed of various discrete electrical components, such as integrated circuit chips, diodes, clocks, etc., that are assembled and mounted on a printed circuit board. The repeater printed circuit board is packaged in a casing and installed in the transmission system to connect or terminate a transmission line. As a practical matter, a group or bank of repeaters are usually installed so as to connect into a corresponding bank of transmission lines. In such case, the casing for each individual repeater printed circuit board is not utilized and the printed circuit boards are placed side by side next to one another within a respective printed circuit board rack or cabinet.

Each component in a transmission system using metallic paired cable is at risk when certain fault conditions, such as power cross (i.e., the contacting of a telephone transmission line with an electrical power line), exist on any transmission line or cable. If a fault condition is not isolated from the circuitry of the components in the system, the fault condition may cause damage, such as fire, overheating, mechanical failure, etc. To isolate such fault conditions from the circuitry in a repeater, a thermal cut-off resistor is placed in the current path of the repeater circuitry to interrupt the high current flow resulting from a fault condition. In operation, high fault current passes through a resistive element of the cut-off resistor and the heat generated by the resistive element causes a fuse element to open within the current path. As a result, the high fault current is interrupted and the circuitry of the repeater is isolated and protected from the fault current.

A drawback of existing thermal cut-off resistors, however, is the mechanical design. In particular, existing thermal cut-off resistors are designed and manufactured as a component having a discrete resistor and a separate discrete fuse, both molded into an insulated casing and with one element placed atop the other element therein. This "vertical" design results in a high profile, or height relative to the printed circuit board surface, for the cut-off resistor which becomes a problem in newly designed repeaters that take advantage of the miniaturization of other board components and in new repeater applications that require close circuit board to circuit board spacing. Although the discrete elements can be miniaturized in order to reduce the profile, there is a limit as to how small the elements can become without adversely affecting the functional characteristics of the elements. Another alternative to achieve a lower profile for an existing cut-off resistor is to arrange the two elements in a horizontal rather than a vertical configuration relative to the printed circuit board surface. Disadvantageously, such a modification exacts a trade-off, namely, the horizontal arrangement increases the "footprint" of the cut-off resistor on the circuit board (i.e., the area of board surface taken up by the cut-off resistor mounted thereon) and, thus, fails to conserve valuable board space, which is a standard design goal for printed circuit board components.

The mechanical design of existing thermal cut-off resistors also affects the efficiency of their operation. In particular, the shapes of the resistor and the fuse, and the spatial relationship with one another, causes the heat radiated by the resistor to be dispersed and not specifically directed towards the separate fuse. As a result, the fuse receives only a portion of the radiated heat and responds more slowly to a fault condition. In addition, the fuse does not receive the radiated heat quickly or uniformly along its body. This sluggishness in the heat transfer and heat response of an existing cut-off resistor leads to an imprecise and inefficient operation and can be particularly damaging to the repeater circuitry in the event of a severe or sudden fault condition.

As is evident, the mechanical and operational drawbacks of existing thermal cut-off resistors are not limited to repeaters, but are equally applicable to any device having a printed circuit board and any printed circuit board application.

Consequently, there is a need for a thermal cut-off resistor that has a lower profile than currently available. Further, there is a need to have such a low profile thermal cut-off resistor without increasing the footprint of the cut-off resistor on a printed circuit board. Further, there is a need to have such a low profile thermal cut-off resistor without affecting the functional characteristics. Moreover, there is a need to have a thermal cut-off resistor that has an increased responsiveness to fault conditions. There is also a need to have such a thermal cut-off resistor that can withstand repeated lightning or simulated lightning transients.

SUMMARY OF THE INVENTION

The aforementioned problems are obviated by the present invention which provides a thermal-responsive overcurrent element; a resistive element that is tightly coupled to the overcurrent element, said resistive element being electrically connected to the overcurrent element in a series arrangement; and an electrically-insulated heat-resistant casing, adapted to be secured to a printed circuit board, that contains the overcurrent element and the resistive element therein and that is configured so that the series arrangement of the overcurrent element and the resistive element is adapted to be electrically connected to an electrical contact formed on the printed circuit board, the physical dimensions of the casing being approximately the physical dimensions of the overcurrent element.

The present invention also provides an overcurrent protective device for an electrical circuit that has means for interrupting the flow of current to the electrical circuit in response to a predetermined amount of heat; a resistive element that radiates heat in response to a current flowing therethrough; and means for electrically connecting the means for interrupting and the resistive element, in a series arrangement, to the electrical circuit, said resistive element being adapted to have a configuration that enables the resistive element to direct with minimal dispersal radiated heat to the means for interrupting.

Advantageously, a thermal cut-off resistor constructed in accordance with the present invention achieves a profile that is substantially lower than the profile of existing thermal cut-off resistors. Further, such a resistor maintains a small "footprint" on a printed circuit board so as to conserve valuable board space. Consequently, the invention enables a thermal cut-off resistor constructed in accordance therewith to be useful in newly designed repeaters that take advantage of component miniaturization and new repeater applications that require close circuit board to circuit board spacing. Moreover, such a resistor can now be utilized in any printed circuit board or printed circuit board application that has limitations or considerations regarding dimension, weight, volume, etc.

Advantageously, a thermal cut-off resistor constructed in accordance with the present invention also achieves a more effective mechanism of operation. As a result, such a resistor is more responsive to a fault condition, i.e., it has a shorter response time and is more precise. This is particularly important for providing overload protection against a severe or sudden fault condition, such as power cross. At the same time, such a cut-off resistor can withstand repeated lightning or simulated lightning voltage transients.

BRIEF DESCRIPTION OF THE DRAWINGS

For a better understanding of the invention, reference is made, to the following description of an exemplary embodiment thereof, and to the accompanying drawings, wherein.

DETAILED DESCRIPTION

Figure 1:
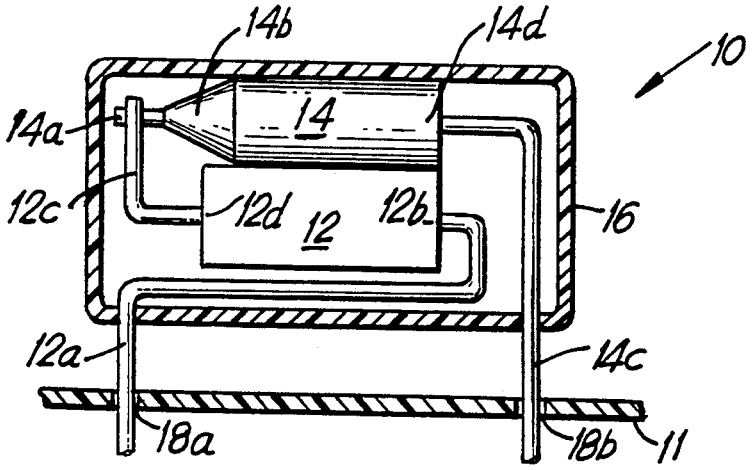
FIG.1 (PRIOR ART)
FIG. 1 is a cut-away side (profile) view of an existing thermal cut-off resistor mounted on a printed circuit board.

FIG. 1 is a cut-away side view (i.e., a profile view) of an existing thermal cut-off resistor 10 mounted on a standard printed circuit board 11. The figure illustrates the profile of the cut-off resistor 10, i.e., the height of the cut-off resistor 10 relative to the printed circuit board 11 surface. The cut-off resistor 10 comprises an elongated discrete resistor 12 having a first electrical conductor lead **12*a* extending out from a first end 12*b* and a second electrical conductor lead 12*c* extending out from a second end 12*d*. The cut-off resistor 10 also comprises an elongated discrete fuse 14 having a first electrical conductor lead 14*a* extending out from a first end 14*b* and a second electrical conductor lead 14*c* extending out from a second end 14*d*. The resistor 12 and the fuse 14 are both encased by a molded casing 16**.

The second lead **12*c* of the resistor 12 is electrically and mechanically connected to the first lead 14*a* of the fuse 14 so that the two elements 12, 14 are in an electrical series arrangement. The first lead 12*a* of the resistor lead 14*c* of the fuse 14 extend through and protrude from one sidewall of the casing 16. The protruding leads 12*a*, 14*c* are sized and shaped to be loosely insertable into respective board holes 18*a*, 18*b* of the printed circuit board 11. The protruding leads 12*a*, 14*c* enable the cut-off resistor 10, via subsequent soldering of the leads 12*a*, 14*c*, to be fixedly mounted on the surface of the printed circuit board 11**.

The physical arrangement of the two elements 12, 14 within the casing 16 is such that the fuse 14 rests upon the resistor 12 when the out-off resistor 10 is mounted on the surface of the printed circuit board 11 (and assuming that the plane of the circuit board 11 surface is parallel to the floor). This "vertical" arrangement permits the cut-off resistor 10 to have a small "footprint" on the circuit board 11 and conserves valuable board space which is a standard design goal for any printed circuit board component. Thus, the profile or the height of the cut-off resistor 10 above the surface of the printed circuit board 11 is approximately the combination of the widths of the resistor 12 and the fuse 14 (excluding the width of the walls of the casing 16 and the portion of the protruding leads **12*a*, 14*c* not inserted into the board holes 18*a*, 18*b***).

Figure 2A:
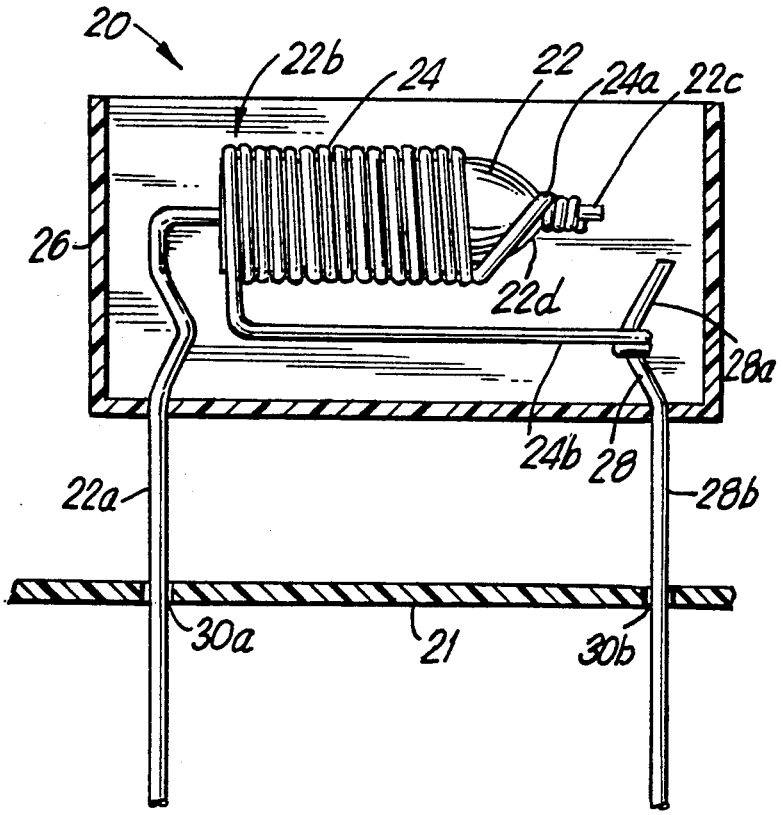
FIG. 2*a* is a cut-away side (profile) view of a thermal cut-off resistor constructed in accordance with the present invention mounted on a printed circuit board.
Figure 2B:
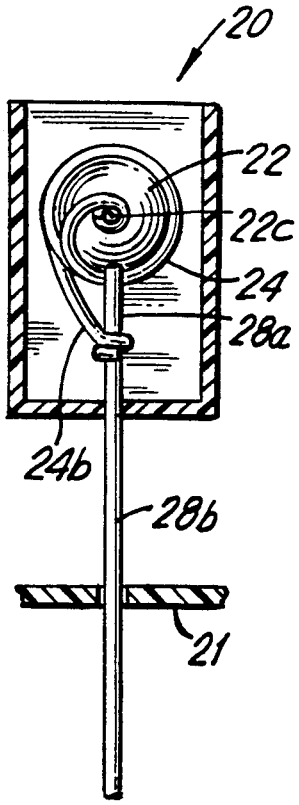
FIG. 2*b* is a cut-away end view of the thermal cut-off resistor of FIG. 2*a*.

FIG. 2*a* is a cut-away side view (i.e., profile view) of a thermal cut-off resistor 20 constructed in accordance with the present invention mounted on a standard printed circuit board 21. The cut-off resistor 20 comprises an elongated overcurrent element 22 having a first electrical conductor lead extending out from a first end **22*b* and a second electrical conductor lead 22*c* extending out from a second end 22*d*. The overcurrent element 22 may be a common thermal cut-off fuse that has an internal current path or fusible link (not shown) formed therein connecting the first conductor lead 22*a* and the second conductor lead 22*c*. The internal current path may be formed by commonly known thermal-responsive, electrically conductive materials. The electrical characteristics of the overcurrent element 22, such as, amperage and voltage ratings, thermal cut-off, and fusing time is dependent on the application. The cut-off resistor 20 also comprises a resistive element 24, shown in the configuration of an insulated wire conductor having an uninsulated first end 24***a* and an uninsulated second end 24*b*. The wire conductor may be made or any other electrically conductive material. Further, the electrical and mechanical characteristics of the resistive element 24, such as, the wire diameter, the wire length, the resistance value, and the wattage rating is dependent upon the application. The overcurrent element 22 and the resistive wire 24 are both encased by an insulated casing 26 which may be made from plastic, thermoplastic, ceramic, or any other material that is resistive to heat and that is not electrically conductive. Further, the two elements 22, 24 may be hermetically sealed within the casing 26 if desired.

The second lead 22*c* of the overcurrent element 22 is electrically and mechanically connected (e.g., via welding) to the first end 24*a* of the resistive wire 24 so that the two elements 22, 24 are in an electrical series arrangement. The second end 24*b* of the resistive wire 24 is electrically and mechanically connected (e.g., via welding) to a first end 28*a* of a free electrically conductive lead or post 28. Thus, the two elements 22, 24 and the free lead 28 are also in an electrical series arrangement. The first lead 22*a* of the overcurrent element 22 and a second end 28*b* of the free lead 28 extend through and protrude from one of the sidewalls of the casing 26. The protruding leads 22*a*, 28*b* are sized and shaped to be loosely insertable into respective board holes 30*a*, 30*b* of the printed circuit board 21. The protruding leads 22*a*, 28*b* enable the cut-off resistor 20, via subsequent soldering of the leads 22*a*, 28*b*, to be fixedly mounted on the surface of the printed circuit board 21. Note that the second end 24*b* of the resistive wire 24 may be configured to protrude from the casing 26 and to be insertable into the respective board hole 30*b* directly without the use of the free lead 28.

The resistive wire 24 is tightly coiled around the body of the overcurrent element 22 so as to be coaxial with the overcurrent element 22. As shown, the coil of resistive wire 24 assumes the general shape of the overcurrent element 22 by following the contour of the overcurrent element 22. Consequently, the profile or the height of the cut-off resistor 20 above the surface of the circuit board 21 is approximately the width of only the overcurrent element 22 (excluding the diameter of the resistive wire 24, the width of the walls of the casing 26 and the portion of the protruding leads 22*a*, 28*b* not inserted into the board holes 30*a*, 30*b*). The cut-off resistor 20 of the present invention achieves a profile or height which is substantially lower than the profile or height of an existing cut-off resistor 10 (as shown in FIG. 1). In the case of the resistor 12 and the fuse 14 being the same width, the height difference is approximately one-half. Furthermore, the cut-off resistor 20 of the present invention also maintains a small "footprint" on the circuit board 21 so as to conserve valuable board space. There is no trade-off of the horizontal dimension for the vertical dimension to achieve a low profile for the cut-off resistor 20. Note that, by reconfiguring the resistive element 24, the cut-off resistor 20 of the present invention also achieves a lower volume and weight than an existing cut-off resistor 10. The lower volume and weight decreases the casing 26 requirements and, thus, reduces the overall cost of the cut-off resistor 20.

Figure 3:
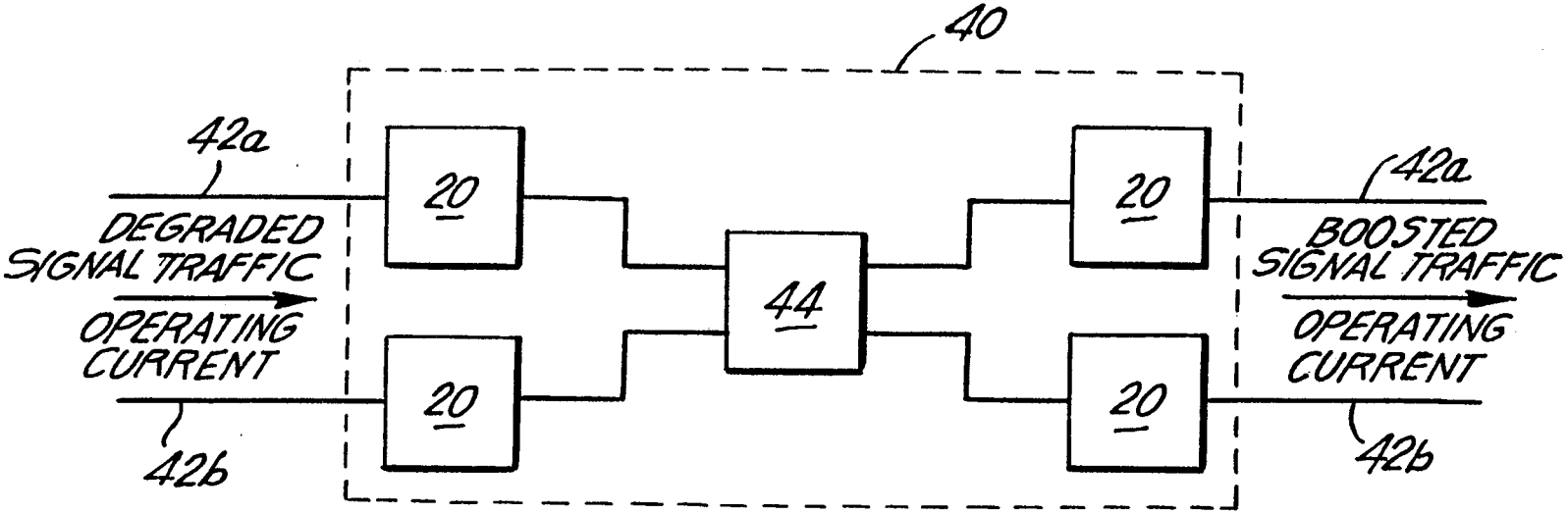
FIG. 3 is a block diagram of a repeater using the thermal cut-off resistor of FIG. 2*a*.

FIG. 3 is a block diagram of a repeater 40 using the thermal cut-off resistor 20 of the present invention. Normally, a pair of transmission lines 42*a*, 42*b* carrying signal traffic will be connected to the repeater 40. The repeater 40 has a thermal cut-off resistor 20 located at both the input and output with the remainder of the repeater circuits 44 connected therebetween. Under no-fault conditions, a degraded digital information signal enters the input of the repeater 40 from the transmission lines 42*a*, 42*b* and is amplified or re-shaped by the repeater circuits 44. A boosted or modified digital information signal then exits from the output of the repeater 40 to the transmission lines 42*a*, 42*b*. Note that the cut-off resistors 20 act as a short circuit for the digital information signal (or signal traffic).

Under no-fault conditions, a standard operating D.C. current, e.g., 60 milliamperes, also flows through the telephone transmission system with the signal traffic to power the various system components, such as, the repeater 40. As shown, the signal traffic and the operating current flow through the transmission lines 42*a*, 42*b* and enter the thermal cut-off resistor 20 at the input of the repeater 40. The overcurrent element 22 and the resistive wire 24 form a short circuit path for the operating current between the protruding leads 22*a*, 28*b* of the cut-off resistor 20. Consequently, the cut-off resistor 20 acts as a part of the normal current path of the repeater 40 circuitry, having a resistance and an attendant voltage drop that are approximately the same as the conductors which connect the cut-off resistor 20 to the other repeater circuit components 44 (e.g., a standard solid copper 18 gauge wire). The amount of heat radiated by the resistive element 24 is minimal when the standard operating current is flowing therethrough. As a result, the overcurrent element 22 does not operate to fuse in response to the radiated heat. Note that the casing 26 of the cut-off resistor 20 is designed to insure proper airflow around the elements 22, 24 therein and, thus, prevents a gradual build-up of heat within the casing 26 and the inadvertent fusing of the overcurrent element 22.

Upon an overload fault condition in the telephone transmission system, such as power cross, high fault current is generated on the current path (i.e., the transmission lines 42*a*, 42*b*) and passes through the system components, including the repeater 40 and, in particular, the cut-off resistor 20 therein. In response to the high current passing therethrough, the resistive wire 24 radiates a certain amount of heat. The amount of heat radiated by the resistive element 24 may be designed as desired and is a function of the amount of fault current, the material selected to make the resistive element 24, and the particular dimensions and shape of the resistive element 24. The coiling of the resistive wire 24 around the overcurrent element 22 directs the radiated heat to the overcurrent element 22 with minimal dispersal. Further, the coiling causes the radiated heat to be quickly and uniformly received by the overcurrent element 22. The overcurrent element 22 reacts to a predetermined amount of radiated heat from the resistive wire 24 by fusing or opening the internal current path between the first conductor lead 22*a* and the second conductor lead 22*c*, thus forming an open circuit. The amount of radiated heat or temperature which causes the overcurrent element 22 to fuse and the response time of the overcurrent element 24 to fuse may be designed as desired.

The open circuit within the overcurrent element 22 interrupts the current path of the cut-off resistor 20 and the repeater 40 in general. More importantly, the overcurrent element 22 interrupts the flow of the high fault current through the cut-off resistor 20 and the repeater 40. Consequently, the other circuit components 44 of the repeater 40 are electrically isolated from the fault condition and prevented from being damaged by the fault condition. With the correction or end of the fault condition, the resistive element 24 gradually ceases to radiate heat except for a nominal amount due to the flow of the standard operating current. The cut-off resistor 20 is then replaced in order to re-establish the current path and permit the operation of the repeater 40 to continue. The cut-off resistor 20 may be designed to be re-usable or resettable so that the overcurrent element 22 can close the internal current path to re-form a short circuit path therethrough in response to the reduction of radiated heat below the fusing amount and that the normal operations of the cut-off resistor 20 and the repeater 40 continue automatically.

Note that the design and functioning of the overcurrent element 22 is coordinated with the design and functioning of the resistive element 24 so that the cut-off resistor 20 operates to interrupt a desired amount of fault current. Also note that, for overload current conditions, the upper limit on the current capacity of the cut-off resistor 20 would normally depend on the environment for each specific application, but because of the coordination between the two components 22, 24, the current capacity will be a function of the maximum fusing temperature of the overcurrent element 22.

The shaping of the resistive element 24 to surround the overcurrent element 24 boosts the performance of the cut-off resistor 20 in several ways. First, the resistive element 24 has an increased surface area so that a higher rate of radiated heat is achieved. This enables the overcurrent element 22 to reduce the fusing response time and the cut-off resistor 20 to operate more efficiently. This also enables the resistive element 24 to dissipate heat more quickly and the overcurrent element 22 to restore the current path more quickly once a fault condition subsides. In addition, the surrounding of the overcurrent element 22 by the resistive element 24 directs and concentrates the radiated heat toward the overcurrent element 22. This increases the amount of radiated heat received by the overcurrent element 22, decreases the time for the radiated heat to be received by the overcurrent element 22 and provides a more uniform amount of radiated heat to the overcurrent element 22.

In sum, the shaping of the resistive element 24 to surround the overcurrent element 22 creates a more effective mechanism to transfer the radiated heat from the resistive element 24 to the overcurrent element 22. Consequently, the cut-off resistor 20 is more responsive to a fault condition, i.e., the response time for the overcurrent element 22 to fuse and interrupt the fault current is faster and the precision of the fusing of the overcurrent element 22 is increased. Further, the concentration of radiated heat reduces the amount of heat received by other circuit components 44 in the repeater 40 that ordinarily would degrade their operation and shorten their lives.

It is important to note also that although the cut-off resistor 20 will interrupt high current surging through the repeater 40 during an overload fault condition, the cut-off resistor 20 will not fuse under high voltage transients caused by lightning or simulated lightning conditions in the transmission system. Advantageously, the overcurrent element 22 may be designed to have sufficient heat sinking capability and a low enough resistance relative to the resistive element 24 so as to allow the overcurrent element 22 to withstand lightning or simulated lightning conditions. Such lightning conditions are commonly experienced, for example, by the telephone pole lines used in a transmission system.

The embodiments described herein are merely illustrative of the principles of the present invention. Various modifications may be made thereto by persons ordinarily skilled in the art, without departing from the scope or spirit of the invention. For example, the resistive element 24 may be wound around the length of the overcurrent element 22 rather than the width so as to have the coil axis orthogonal to the axis of the overcurrent element 22. Also, the resistive element 24 may be surface-mounted to the overcurrent element 22 rather than coiled around the body. In either case, the configuration of the packaging and the casing 26 may be slightly different than illustrated in the figures but the cut-off resistor 20 profile would remain substantially the same. Also, the configuration of the resistive element 24 may be any shape and size, other than a coiled wire, that can effectively transfer radiated heat to the overcurrent element 22 such as a resistive sheath or wire mesh around the overcurrent element 22. In addition, the overcurrent element 22 may be designed to fuse in response to the amount of radiated heat, the rate of temperature increase, or any other thermal parameter as desired. Further, the cut-off resistor 20 may adapted to be surface-mounted on the printed circuit board 21.

What is claimed is:

1. A thermal cut-off resistor, comprising:
   a. an elongated thermal cut-off fuse having first and second electrical conductor leads extending from respective ends of the fuse;
   b. an electrically-insulated wire-shaped resistor that is tightly coiled around the fuse, said resistor having a first non-insulated end that is connected to the second conductor lead and a second non-insulated end so that the fuse and the resistor are in an electrical series arrangement; and
   c. an electrically-insulated heat-resistant casing that contains the fuse and resistor therein and that is configured so that the first conductor lead of the fuse and the second non-insulated end of the resistor protrude from the casing to enable the lead and the end to be electrically connected to respective electrical contacts formed on a printed circuit board and the casing to be secured lengthwise to said board, the profile of the casing being approximately the width of the fuse.

2. The thermal cut-off resistor of claim 1, wherein said wire-shaped resistor is tightly coiled around the fuse in a co-axial manner.

3. The thermal cut-off resistor of claim 1, wherein said wire-shaped resistor is a nichrome wire.

4. The thermal cut-off resistor of claim 1, wherein said casing is adapted to provide sufficient airflow around said fuse and resistor within the casing so as to avoid a build-up of heat therein.

5. The thermal cut-off resistor of claim 1, wherein said casing is surface-mounted on the printed circuit board.

6. A thermal cut-off resistor, comprising:
   a. a thermal-responsive overcurrent element;
   b. a resistive element that is tightly coupled to the overcurrent element, said resistive element being electrically connected to the overcurrent element in a series arrangement; and c. an electrically-insulated heat-resistant casing, adapted to be secured to a printed circuit board, that contains the overcurrent element and the resistive element therein and that is configured so that the series arrangement of the overcurrent element and the resistive element is adapted to be electrically connected to an electrical contact formed on the printed circuit board, the physical dimensions of the casing being approximately the physical dimensions of the overcurrent element.

7. The thermal cut-off resistor of claim 6, wherein said resistive element is configured to cover at least a portion of the overcurrent element.

8. The thermal cut-off resistor of claim 6, wherein said resistive element is configured to overlay and assume the general shape of the overcurrent element.

9. The thermal cut-off resistor of claim 6, wherein said resistive element is configured to be an electrically-conductive wire that is tightly coiled around the overcurrent element.

10. The thermal cut-off resistor of claim 6, wherein said casing is adapted to provide sufficient airflow around said overcurrent element and said resistive element within the casing so as to avoid a build-up of heat therein.

11. The thermal cut-off resistor of claim 6, wherein said casing is surface-mounted on the printed circuit board.

12. The thermal cut-off resistor of claim 6, wherein said overcurrent element is adapted to have sufficient heat-sinking capability and a low enough resistance relative to the resistive element so as to allow the overcurrent element to withstand lightning transients.

13. The thermal cut-off resistor of claim 6, wherein the overcurrent element interrupts the flow of current therethrough in response to a predetermined amount of heat; and the resistive element radiates heat in response to a current flowing therethrough, said resistive element being configured to direct with minimal dispersal radiated heat to the overcurrent element.

14. The thermal cut-off resistor of claim 13, wherein the overcurrent element enables, after each operation of use, the flow of current therethrough in response to a reduction of the radiated heat by the resistive element below the predetermined amount of heat.

15. The thermal cut-off resistor of claim 13, wherein the amount of radiated heat from the resistive element is proportional to the amount of current flowing therethrough.

16. The thermal cut-off resistor of claim 13, wherein the amount and rate of radiated heat from the resistive element is a function of the particular configuration of the resistive element.

17. The thermal cut-off resistor of claim 13, wherein the resistive element is configured to maximize the rate of radiated heat from the resistive element to the overcurrent element.

18. The thermal cut-off resistor of claim 13, wherein the resistive element is configured to maximize the amount of radiated heat from the resistive element to the overcurrent element.

19. A repeater for a transmission line in a digital data transmission system, comprising:

a. an electrical circuit that receives digital data signals transmitted by the system, modifies the signals, and retransmits the modified signals to the system;

b. a printed circuit board for mounting the electrical circuit thereon; and c. a thermal cut-off resistor, electrically connected to the electrical circuit, that has a thermal-response overcurrent element; a resistive element that is electrically connected to the overcurrent element in a series arrangement and tightly coupled thereto; and a casing adapted to contain the overcurrent element and the resistive element therein and to secure said elements to the printed circuit board, the resistive element being coupled to the overcurrent element in such a manner that the physical dimensions of the casing is approximately the physical dimensions of the overcurrent element.

20. The repeater of claim 19, wherein said overcurrent element is adapted to have sufficient heat-sinking capability and a low enough resistance relative to the resistive element so as to allow the overcurrent element to withstand lightning transients.

21. The repeater of claim 19, wherein said resistive element is configured to overlay and assume the general shape of the overcurrent element.

22. The repeater of claim 19, wherein said resistive element is an electrically-conductive wire that is tightly coiled around the overcurrent element.

* * * * *